US005682983A

United States Patent [19]

Weaver et al.

[11] Patent Number: 5,682,983

[45] Date of Patent: Nov. 4, 1997

[54] CARRIER WITH MEANS FOR PARTIALLY BLOCKING A BAR CODE

[75] Inventors: William N. Weaver, Northbrook; Peter L. Samaras, Elk Grove Village, both of Ill.

[73] Assignee: Illinois Tool Works Inc., Glenview, Ill.

[21] Appl. No.: 681,068

[22] Filed: Jul. 22, 1996

Related U.S. Application Data

[63] Continuation of Ser. No. 386,546, Feb. 10, 1995, abandoned.

[51] Int. Cl.[6] ..... B65D 85/00; G06K 19/00

[52] U.S. Cl. ..... 206/150; 206/427; 206/459.5

[58] Field of Search ..... 206/139, 150, 206/427, 428, 429, 435, 459.5, 446

[56] References Cited

U.S. PATENT DOCUMENTS

| | | | |
|---|---|---|---|
| 3,330,408 | 7/1967 | Wanderer . | |
| 4,219,117 | 8/1980 | Weaver et al. . | |
| 4,232,807 | 11/1980 | Beier et al. | 206/139 |
| 4,269,308 | 5/1981 | Platt | 206/150 |
| 4,359,633 | 11/1982 | Bianco . | |
| 4,431,693 | 2/1984 | Skukowski . | |
| 4,486,363 | 12/1984 | Pricone et al. . | |
| 4,557,375 | 12/1985 | Weaver et al. . | |
| 4,669,611 | 6/1987 | Flaherty . | |
| 4,805,772 | 2/1989 | Shaw et al. | 206/459.5 |
| 4,827,114 | 5/1989 | Blachon . | |
| 4,850,488 | 7/1989 | Humbert . | |
| 4,941,573 | 7/1990 | Fuerstman . | |
| 5,072,829 | 12/1991 | Marco et al. | 206/150 |
| 5,211,711 | 5/1993 | Marco | 206/150 |
| 5,218,192 | 6/1993 | Fujii et al. . | |
| 5,492,222 | 2/1996 | Weaver | 206/150 |
| 5,544,749 | 8/1996 | Watts | 206/150 |

*Primary Examiner*—Paul T. Sewell
*Assistant Examiner*—Luan K. Bui
*Attorney, Agent, or Firm*—Trexler, Bushnell, Giangiorgi & Blackstone, Ltd.

[57] ABSTRACT

A novel carrier for carrying a group of items, such as cans, bottles or the like which hold beverages, foods or the like, is made of a plastic material having an opaque strip of material printed on a surface of the carrier. The opaque strip can be a solid, opaque line or a series of opaque dots. Each item includes an individual machine readable bar code thereon which is at least partially covered by the opaque strip. The package has a machine readable bar code thereon which is not covered by the opaque strip on the carrier. The opaque strip prevents the individual bar codes on the items from being read by a typical bar code reader beam. The bar code on the package can be read since it is not covered by the opaque strip.

12 Claims, 1 Drawing Sheet

CARRIER WITH MEANS FOR PARTIALLY BLOCKING A BAR CODE

This application is continuation of U.S. patent application Ser. No. 08/386,546 filed Feb. 10, 1995 now abandoned.

BACKGROUND OF THE INVENTION

This invention is generally directed to a novel, plastic carrier for a group of items, such as cans, bottles or the like which hold beverages, foods or the like. More particularly, the invention contemplates a plastic carrier which groups together the items and prevents individual bar codes on each item from being read by a typical laser bar code reader beam.

Bar codes are widely used on items so that information about the item, such as price, can be easily and quickly read by scanning the bar code with a bar code reader beam. When the bar code is scanned, the bar code number is input into a computer to retrieve stored information about the item.

When items are grouped together in a package for sale, each item typically includes an individual machine readable bar code. The package is additionally labelled with a bar code which corresponds to the price of the group of items.

In a package that has a substantially transparent carrier, e.g. a band type carrier as shown in U.S. Pat. No. 4,219,117 or U.S. Pat. No. 4,557,375, when the package is scanned for a price, a bar code from an individual item could be scanned instead of the bar code on the package itself. If this occurs, information which correlates to the individual item would be retrieved and the purchaser of the package will be charged the individual price instead of the group package price. This can result in significant losses to the seller.

The present invention is intended to overcome or minimize these problems as well as to present improvements and additional advantages.

OBJECTS AND SUMMARY OF THE INVENTION

A general object of the present invention is to provide a novel, plastic carrier for a group of items, such as cans, bottles or the like which hold beverages, foods or the like and which will block scanning of bar codes or other indicia on the individual items.

Another object of the present invention is to provide a plastic carrier having an opaque strip thereon which prevents individual bar codes on each item from being read by a typical laser bar code reader beam.

Briefly, and in accordance with the foregoing, the present invention discloses a carrier for carrying a group of items, such as cans, bottles or the like which hold beverages, foods or the like. The items, when encircled by the carrier, form a package. The carrier is made of a plastic material and has an opaque strip of material on a surface of the carrier. The opaque strip can be a solid, opaque line or a series of opaque dots. Each individual item includes an individual machine readable bar code thereon which, when the carrier is attached thereto, is at least partially covered by the opaque strip on the carrier. The opaque strip prevents the individual bar code on the individual items from being read by a typical laser bar code reader. The package may include a machine readable bar code thereon which is not covered by the opaque strip. The package bar code can be read by the laser bar code reader to retrieve data about the package, such as the price of the complete package.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
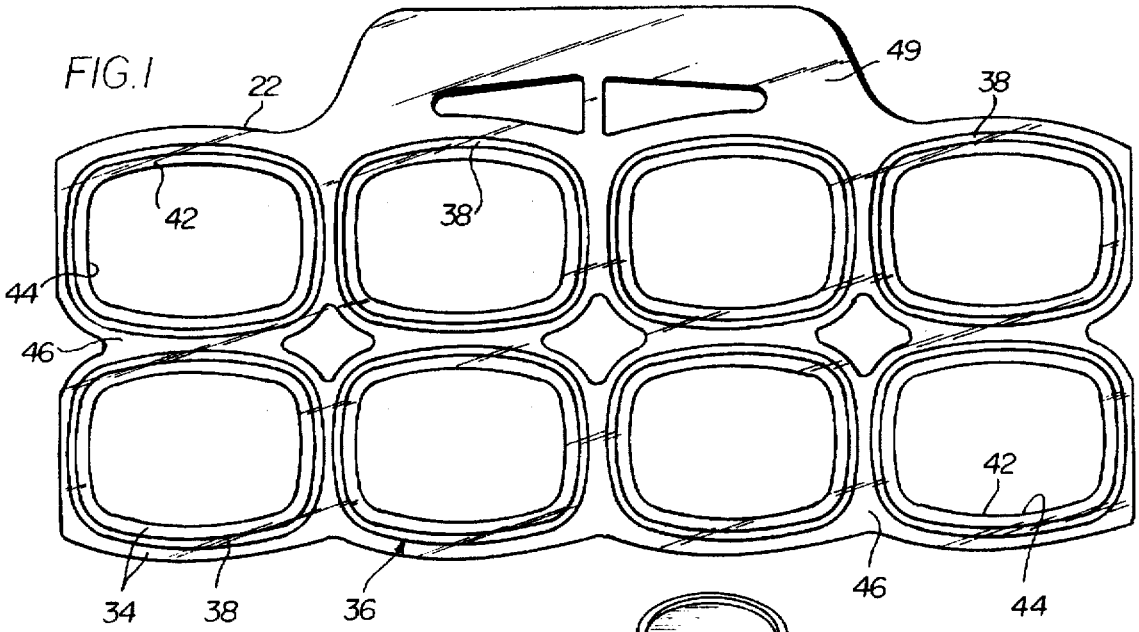
FIG. 1 is a top plan view of a carrier having an opaque strip on a surface thereof having features in accordance with a first embodiment of the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
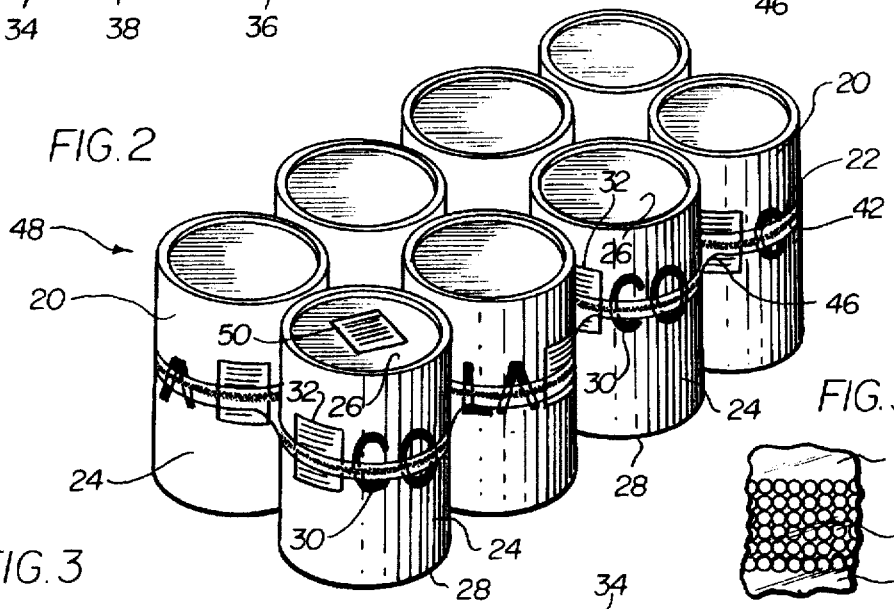
FIG. 2 is a perspective view of a plurality of cans encircled by the carrier shown in FIG. 1.

As shown in FIG. 2, a plurality of items, e.g. cans, 20 are grouped together and surrounded by a novel carrier 22 shown in detail in FIG. 1. The items 20 shown in FIG. 1 are typical cans which hold beverages, foods or the like, each of which include a cylindrical side wall 24 having an exterior face, a top wall 26 and a bottom wall 28. The exterior face of the side wall 24 can be decorated with graphics or writing 30 for aesthetic purposes or identification of the product.

The exterior face of the side wall 24 of each item 20 also includes a machine readable bar code 32 thereon having a plurality of horizontal lines. The individual bar codes 34 can be printed on the exterior face of each item 20 or otherwise affixed to the item 20 by suitable known means, for example by adhesive. The bar code 32 on each individual item 20 allows the item 20 to be scanned by a typical laser bar code reader. When the bar code 32 on the item 20 is scanned by a bar code reader (not shown), information, such as the price, about the individual item 20 is retrieved from a computer attached to the bar code reader.

The bar code scanners or readers used today are Helium/Neon laser bar code readers which typically emits a beam of light in a wavelength of about 630 nanometers or 670 nanometers to scan and read a bar code on an item or package.

Figure 3A:
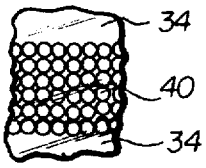
FIG. 3A is an enlarged sectional view of a portion of the carrier of FIG. 3 to show the details of the strip of opaque dots.
Figure 3:
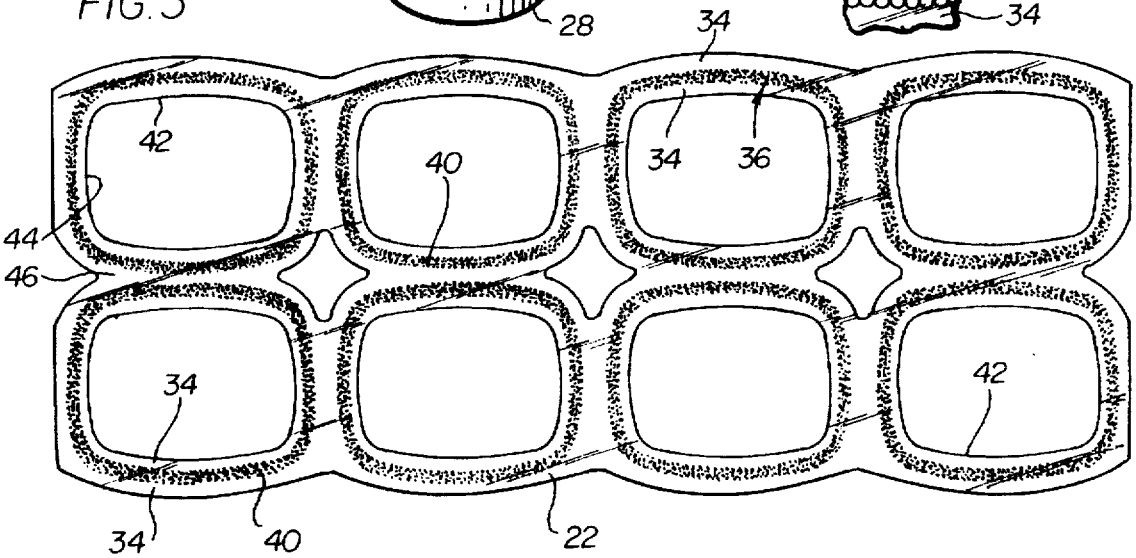
FIG. 3 is a top plan view of a carrier having a strip of opaque dots on a surface thereof having features in accordance with a second embodiment of the present invention.

The carrier 22 of the present invention is made of a suitable plastic material, such as low to medium density, resilient polyethylene. The carrier 22 has substantially transparent portions 34 and an opaque strip of material 36 thereon. Opaque, in describing this invention shall mean sufficient to prevent the laser beam from transmitting through the carrier in the region of the line. As shown in FIG. 1, the opaque strip 36 can be a solid opaque line 38. As shown in FIG. 3, the opaque strip 36 can be a densely spaced dot pattern 40 which is generally the same width as the solid opaque line 38 shown in FIG. 1. The opaque strip 36, viz. the solid line 38 or the dot pattern 40, is affixed to the carrier 22 by suitable known methods, such as printing the opaque strip 36 on a surface of the carrier 22 or the like and the opaque strip 36 is made of suitable, known materials, such as ink or the like. The opaque strip 36, if desired, may be affixed to both sides of the carrier 22. As illustrated in the drawings, the opaque strip 36 is generally between the transparent portions 34. The strip 36 or dot pattern 40 is preferably ⅛" to cover at least 2 "modules" or lines of the bar code.

As shown in FIGS. 1 and 3, the carrier 22 is made of a plurality of bands 42 having apertures 44 therein. The bands 42 are integrally joined at 46. The cans 20 are securely held within the apertures 44 so that each band 42 completely encircles and surrounds each individual can 20. Each band 42 of the carrier 22 resiliently contacts and grips each can 20 along its side wall 24. As shown in FIG. 1, the carrier 22 may include an integral handle 47. The carrier 22 groups the items 20 together so that a group of items 20 may be sold as a package 48.

The opaque strip 36, viz. the solid line 38 or the dot pattern 40, form an annular band around each aperture 44 in the carrier 22. When the carrier 22 is affixed to the cans 20, to prevent the bar code 32 on an individual can 20 from being read by a bar code reader beam, the carrier 22 is placed in a position along the side wall 24 in such a manner that the opaque strip 36 totally covers at least one line on each bar code 32 on each individual can 20 when the bar code is aligned so the lines on the bar code are parallel to the opaque line of the carrier. While the line 38 is shown intermediate the edges of the carrier, it could be positioned at an edge and still function in accordance with the description herein.

Since the strip 38 is impervious to light emitted by the laser bar code reader beam, when the laser reader beam scans the package 48, the opaque strip 38 prevents the covered line or lines on the individual bar codes 32 from being read by the bar code reader beam and the information about an individual item 20 cannot be retrieved.

While the strip 36 is impervious to the laser beam, the graphics and/or writing 30 on the cans 20 is only partially obscured to the human eye. Thus, the graphics and/or writing 30 can still be generally seen by the human eye through the opaque strip 36 and the opaque strip 36 minimally detracts from the aesthetics of the exterior of the can 20.

The opaque strip 36 only needs to cover a minimum of one line of the bar code 32 on each individual can 20 so that the light beam from the bar code reader will be confused and cannot read the individual bar code 32 on the can 20. It is within the scope of the invention, however, that the opaque strip 36 can completely cover each bar code 32 on each individual can 20.

The package 48 may have a machine readable bar code 50 on it which is not covered by the carrier 22. Alternatively, a machine readable bar code may be on the outer surface of the carrier 22 (not shown) so that the bar code is on top of the opaque strip 36. These bar codes allow a laser bar code reader to retrieve information about the package 48, such as the price of the group of items 20, when these bar codes are scanned by the reader beam. The package bar code 50 may be printed on the exterior of one of the cans 20 or on the carrier 22 or otherwise affixed to a can 20 or the carrier 22 by suitable known means, such as adhesive.

The items 20 shown in FIG. 2 are typical cans which hold beverages, foods or the like, however, it is to be understood that other types of items, such as bottles or boxes may be grouped together and surrounded by the carrier 22. Also, as shown in FIG. 2, the carrier 22 has a plurality of continuous bands 42, each of which encircles a can 20. It is to be understood that the carrier 22 may be of a variety of forms, such as a single sheet of plastic formed to fit around the items 20.

While preferred embodiments of the present invention are shown and described, it is envisioned that those skilled in the art may devise various modifications of the present invention without departing from the spirit and scope of the appended claims. The invention is not intended to be limited by the foregoing disclosure.

The invention claimed is:

1. A carrier comprising: a plurality of individual, plastic, annular bands joined together, each said annular band having a predetermined width; and an annular strip of opaque material provided on each said annular band, each said annular strip of opaque material having a predetermined width which is less than the predetermined width of said annular band on which said annular strip of opaque material is provided, each said annular strip of opaque material extending completely around each said annular band.

2. The carrier as defined in claim 1, wherein each said annular strip of opaque material is a solid opaque line.

3. The carrier as defined in claim 1, wherein each said annular strip of opaque material is a densely spaced pattern of opaque dots.

4. The carrier as defined in claim 1, wherein each said annular band includes at least one substantially transparent annular portion completely around each said annular strip of opaque material.

5. The carrier as defined in claim 1, wherein each said annular strip of opaque material is printed on a surface of each said annular band.

6. The carrier as defined in claim 1, further including a machine readable bar code on said carrier which is not covered by said annular strips of opaque material.

7. The carrier as defined in claim 1, wherein the plastic of which said annular bands is formed is polyethylene.

8. A package comprising;

a carrier;

a group of items retained by said carrier, each said item having a machine readable bar code thereon, each said bar code being formed from a plurality of parallel lines;

said carrier comprising a plurality of individual annular, plastic bands joined together, each said annular band having a predetermined width and gripping one of said items therein and overlaying said bar code thereon, an annular strip of opaque material provided on each said annular band and disposed to be parallel with said bar code lines of said bar code which is overlaid by said annular band for totally covering at least one line thereof and for preventing machine reading thereof, each said annular strip of opaque material having a predetermined width which is less than the predetermined width of the annular band on which the annular strip of opaque material is disposed and extending completely around the annular band on which the annular strip of opaque material is disposed such that the item gripped by the annular band is completely encircled by the annular opaque strip.

9. The package as defined in claim 8, wherein each said annular strip of opaque material is a solid opaque line around each annular band.

10. The package as defined in claim 8, wherein each said annular strip of opaque material is a densely spaced dot pattern around each annular band.

11. The package as defined in claim 8, wherein the plastic of which said annular bands is formed is polyethylene.

12. The package as defined in claim 8, wherein each said annular opaque strip of material coincides with said lines of said respective bar codes on the item gripped by said respective annular band.

* * * * *